United States Patent [19]

Magarian

[11] 4,058,031

[45] Nov. 15, 1977

[54] WRENCH FOR A SUBSTANTIALLY CIRCULAR WORKPIECE

[76] Inventor: Masick C. Magarian, 4481 N. Palm Ave., Fresno, Calif. 93704

[21] Appl. No.: 691,089

[22] Filed: May 28, 1976

[51] Int. Cl.[2] ..... B25B 13/52

[52] U.S. Cl. ..... 81/64; 81/3.43

[58] Field of Search ..... 81/64, 3.4, 3.43

[56] References Cited

U.S. PATENT DOCUMENTS

| | | | |
|---|---|---|---|
| 2,015,565 | 9/1935 | Loeber | 81/64 |
| 2,519,447 | 8/1950 | Ensminger | 81/64 |
| 3,087,364 | 4/1963 | Witmer | 81/121 R X |
| 3,121,355 | 2/1964 | Morel et al. | 81/3.4 X |
| 3,812,741 | 5/1974 | Heine | 81/3.4 |

*Primary Examiner*—James L. Jones, Jr.
*Attorney, Agent, or Firm*—Huebner & Worrel

[57] ABSTRACT

A wrench for a substantially circular workpiece having an annular elastic body of rubber, plastic or the like adapted to be tensioned about the workpiece and having a resiliently compressible inner surface adapted to conform to the workpiece when the body is tensioned thereabout, and an outer surface providing outwardly extended grasping protuberances.

7 Claims, 5 Drawing Figures

WRENCH FOR A SUBSTANTIALLY CIRCULAR WORKPIECE

BACKGROUND OF THE INVENTION

The present invention relates to a wrench for substantially circular workpieces and more particularly to a wrench for providing improved connection and disconnection of garden hoses and the like.

Gardeners in irrigable areas are constantly plagued with the deployment and redeployment of hoses which supply water to sprinklers, bubblers, and other irrigation appliances. The problems of leakage of the hose connections are universally encountered and largely endured rather than corrected. This leads to the waste of scarce water, the misapplication of water, the encouragement of the growth of weeds in areas which could be devoid of weeds if left dry, and other objectionable consequences.

Generally, the problem of leakage stems from inadequate tightening of the hose fittings involved. Such hose fittings usually require the screw threaded interconnection of male and female coupling elements by manual grasping and turning action. Such fittings provide notoriously little mechanical advantage for the manual turning action over the screw threaded interconnection. Thus, binding of the screw threads, dirt and other obstructions in the screw threads, improper alignment, inadequately compressed gaskets and the like quite commonly result in leakage. It is also known that leakage also occurs when the person manipulating the fittings lacks sufficient manual strength to effect proper connection.

SUMMARY OF THE INVENTION

An object of the present invention is to provide an improved wrench for substantially circular work pieces.

Another object is to facilitate the connection and disconnection of garden hoses and the like.

Another object is to provide a wrench having special facility for the tightening of hose fittings and the like.

Another object is to provide such a wrench which can be effectively employed by even those having little manual strength or dexterity.

Another object is to provide such a wrench which optionally can become a permanent fixture on a circular workpiece or be removably utilized thereon.

A further object is to provide such a wrench which is economical, durable and fully effective in performing its intended functions.

DESCRIPTION OF THE PREFERRED EMBODIMENT

Figure 1:
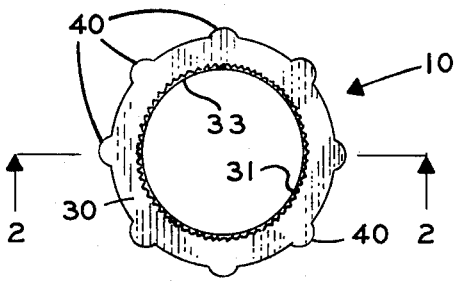
FIG. 1 is an axial view of a wrench embodying the principles of the present invention.
Figure 2:
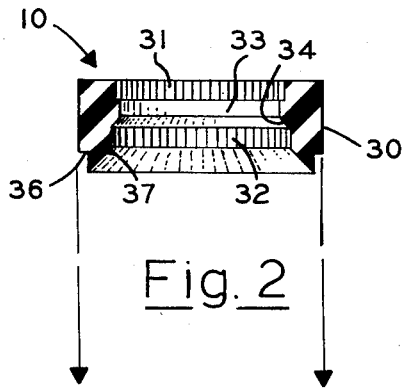
FIG. 2 is a diametric section of the wrench taken on line 2—2 of FIG. 1.
Figure 3:
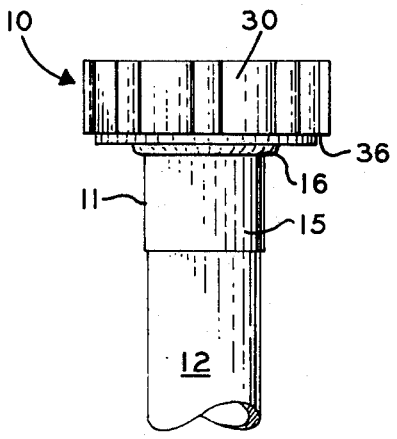
FIG. 3 is a side view of a segment of a hose having a conventional screw threaded fitting with the wrench of the present invention mounted thereon.

Referring in greater detail to the drawing, the wrench of the present invention is designated generally at 10. To illustrate its use, the wrench is shown in FIG. 3 mounted on a fitting 11 borne by a hose 12.

Figure 4:
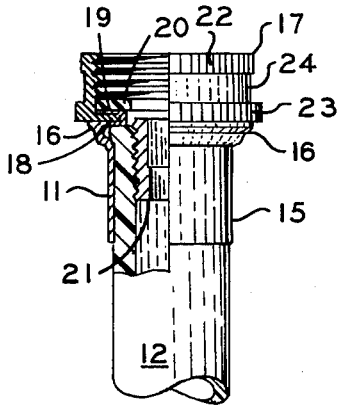
FIG. 4 is a view similar to FIG. 3 but with the wrench of the present invention removed from the conventional fitting and half of the fitting diametrically sectioned to reveal the interior thereof.
Figure 5:
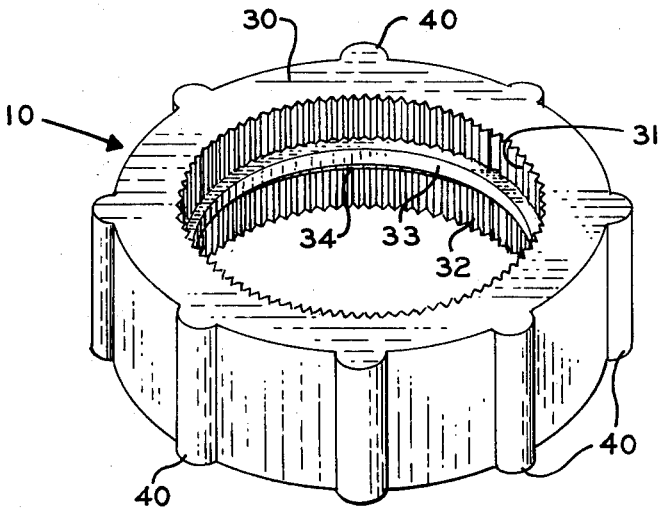
FIG. 5 is a somewhat enlarged perspective of the wrench of the present invention.

As best seen in FIG. 4, the fitting 11 has a sleeve 15 secured to the hose 12 and circumscribed by an annular stop 16. A screw threaded coupling 17 has an inwardly directed flange 18 which rests on the stop 16 and is rotatably captured on the sleeve by a circumscribing flange 19. A compressible washer 20 is rested on the flange 19 within the coupling 17. The sleeve 15 is secured to the hose 12 by means of a hollow male screw threaded bolt 21 screw threadably mounted in the hose from within the coupling and clamping the hose between the sleeve and the bolt. The exterior of the coupling 17 is circumscribed by a pair of spaced series of serrations 22 and 23 separated by a cylindrical portion 24. The endmost series of serrations 22 is flush with the cylindrical portion 24. The inner series of serrations 23 is of a diameter slightly greater than the cylindrical portion 24. The individual serrations of the series 22 and 23 are elongated longitudinally of the coupling 17. The described structure of the fitting 11 and hose 12 is essentially conventional and constitutes an operational environment for the wrench of the present invention.

The wrench 10 has an annular elastic body 30 having an axial opening therethrough providing inwardly disposed series of serrations 31 and 32 spaced to engage the series of serrations 22 and 23 respectively of the coupling 17. The series of serrations 31 and 32 are separated by a substantially cylindrical ridge adapted to engage the cylindrical portion 24 of the coupling 17. The diameters of the series of serrations 31 and 32 are such as to fit tightly about their respective series of serrations 22 and 23. The individual serrations of the series 31 and 32 are elongated longitudinally of the body 30. The series of serrations 31 and 32 and the cylindrical ridge 33 are resiliently compressible so that when the body 30 is fitted externally onto the coupling 17, the body is tensioned to press the series of serrations 31 and 32 and the cylindrical ridge 33 tightly against the series of serrations 22 and 23 and cylindrical portion 24, respectively. The ridge 33 has a forward axial end 34 which is preferably beveled for ease of passage over the series of serrations 31 and onto the cylindrical portion 24. The body is made of rubber plastic or other elastic, resiliently compressible material preferably having a high coefficient of friction.

The body 30 has a forward end 36 which provides an annular funnel shaped surface 37 endwardly and outwardly extended from the opening in the body.

The exterior of the body 30 has elongated ridges or protuberances 40 extended longitudinally of the body to facilitate gripping.

OPERATION

The operation of the preferred embodiment of the present invention is believed to be readily apparent and is briefly summarized at this point. To mount the wrench 10 on the coupling 17, the forward end 36 of the body 30 is pressed against the outer end of the coupling so that the funnel shaped surface 37 guides the body onto the coupling. The beveled end 34 of the cylindrical ridge 33 also facilitates positioning of the wrench on the coupling. Since the series of serrations 32 is of a slightly greater diameter than the series of serrations 22, the initial sliding of the wrench onto the coupling is readily accomplished. When fully in position the series of serrations 32 is tightly fitted about the series of serrations 22. Further, the cylindrical ridge 33 is compressed against the cylindrical portion 24 of the coupling 17. When so positioned, the body 30 is under sufficient tension to compress the engaging serrations tightly against each other and to compress the cylindrical ridge tightly against the cylindrical portion of the coupling in frictional engagement therewith. So mounted, the exterior surface of the wrench 10 can be readily grasped and turned by grasping the ridges 40 to tighten the coupling against any mating screw threaded male member, not shown. Manual turning forces exerted against the ridges 40 to serve to increase the grasping engagement of the series of serrations 31 and 32 against the series of serrations 22 and 23 so that driving engagement with the coupling 17 is maintained. It will be obvious that the wrench is employable with equal facility to tighten hose fittings and the like or loosen the same.

The wrench 10 of the present invention is so economical to produce that it is feasible to provide one such wrench for each fitting 11 employed so that such wrenches may remain permanently in position for ready use. It will be equally obvious that, if desired, the wrench 10 can be removed from the fitting simply by sliding it endwardly therefrom and may subsequently be installed on the same or any similar fitting 11.

By means of the wrench of the present invention, a person having little manual strength or dexterity can dependably connect hose fittings sufficiently tightly to avoid leakage. Thus, the waste of water is minimized, the inconvenience of having water discharged where it is not wanted is avoided, and the connection and disconnection of garden hoses and the like facilitated.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A wrench for a substantially circular workpiece comprising an annular elastic body adapted to be tensioned about a workpiece and having a resiliently compressible inner surface adapted to conform to the workpiece when the body is tensioned thereabout, said body having an axial opening and predetermined forward and rearward ends, the inner surface having sets of serrations adjacent to the opposite ends with the individual serrations elongated axially of the opening, the set of serrations adjacent to the forward end being of a diameter approximately but larger than the diameter of the serrations at the rearward end to facilitate installation, and said body having an outer surface providing outwardly extended grasping protuberances.

2. The wrench of claim 1 in which the forward end has an annular funnel-shaped surface endwardly and outwardly extended from the opening to facilitate guiding of the wrench onto a workpiece.

3. The wrench of claim 1 in which the sets of serrations are separated by a substantially cylindrical ridge of a diameter less than that of the set of serrations at the forward end.

4. The wrench of claim 3 in which the cylindrical ridge has a beveled forward edge to facilitate mounting the wrench on a workpiece.

5. In combination with a female hose coupling having opposite axial ends circumscribed by sets of serrations with the individual serrations being elongated longitudinally of the coupling, said coupling having a cylindrical surface between such sets, an annular elastic body having an axial opening therethrough providing inwardly disposed sets of serrations spaced to engage the serrations of the coupling with an inwardly disposed ridge between the serrations frictionally engaged with the cylindrical surface of the coupling and having outwardly disposed protuberances.

6. The combination of claim 5 in which the inwardly disposed ridge is substantially cylindrical and has a beveled forward end to facilitate slidable movement of the ridge onto and over the endmost set of serrations of the coupling and the cylindrical surface thereof.

7. A wrench for a substantially circular workpiece comprising an annular elastic body having open opposite axial ends, said body being adapted to be tensioned about the workpiece, having a resiliently compressible inner surface adapted to conform to the workpiece when the body is tensioned thereabout, and an outer surface providing outwardly extended protuberances, the inner surface of the body having sets of serrations adjacent to opposite ends of the body with the individual serrations elongated axially of the body, the set of serrations adjacent to one end of the body being of a diameter less than the diameter of the set of serrations at the opposite end of the body and the sets being separated by a substantially cylindrical inwardly disposed ridge of a diameter less than that of the set of serrations of the larger diameter.

* * * * *